US006643857B1

(12) United States Patent
Kenna et al.

(10) Patent No.: US 6,643,857 B1
(45) Date of Patent: Nov. 11, 2003

(54) DECORATIVE COVER FOR SWIMMING POOL POP-UP CLEANING HEADS

(75) Inventors: Michael Kenna, Mesa, AZ (US); Matthew Terrell, Phoenix, AZ (US)

(73) Assignee: Caretaker Systems, Inc., Scottsdale, AZ (US)

( * ) Notice: Subject to any disclaimer, the term of this patent is extended or adjusted under 35 U.S.C. 154(b) by 0 days.

(21) Appl. No.: 10/184,335

(22) Filed: Jun. 26, 2002

(51) Int. Cl.[7] ..... E04H 4/16
(52) U.S. Cl. ..... 4/490; 239/203
(58) Field of Search ..... 4/490, 492, 496; 239/201, 203, 204, 205, 206, 288.3, 288.5

(56) References Cited

U.S. PATENT DOCUMENTS

| | | | | | |
|---|---|---|---|---|---|
| 1,255,648 | A | * | 2/1918 | Sagan | 239/203 |
| 1,605,242 | A | | 11/1926 | Keyes | 239/206 |
| 3,272,437 | A | * | 9/1966 | Coson | 239/206 |
| 3,709,435 | A | | 1/1973 | Sheets | 239/206 |
| 4,229,832 | A | | 10/1980 | Dickson, Sr. | 137/81.2 |
| 4,300,246 | A | * | 11/1981 | Gould | 4/490 |
| 4,322,860 | A | * | 4/1982 | Gould | 4/490 |
| 4,781,327 | A | * | 11/1988 | Lawson et al. | 239/203 |
| 5,251,343 | A | * | 10/1993 | Goettl | 4/490 |
| 5,926,865 | A | | 7/1999 | Witinski | 4/496 |
| 6,301,723 | B1 | | 10/2001 | Goettl | 4/490 |

* cited by examiner

*Primary Examiner*—Robert M. Fetsuga
(74) *Attorney, Agent, or Firm*—LaValle D. Ptak

(57) ABSTRACT

Pop-up cleaning heads of the type used in intermittently operated water delivery systems for cleaning pools and the like are provided with a decorative cover, removably attached to the upper surface of the pop-up cleaning head and extending beyond the edge of the cleaning head to overlie the top of the sleeve in which the cleaning head reciprocates. The decorative cover bears indicia and coloring on its upper surface selected to match the appearance of the pool floor surrounding the water delivery system.

17 Claims, 4 Drawing Sheets

DECORATIVE COVER FOR SWIMMING POOL POP-UP CLEANING HEADS

BACKGROUND

A popular type of swimming pool cleaning system currently finding widespread acceptance is one which utilizes pop-up cleaning heads located in the floor, steps, and sometimes the walls of the pool. These cleaning heads are intermittently supplied with pressurized water to activate them. When the heads are inactive, they retract into a sleeve, and are substantially flush with the adjoining surface of the pool. Whenever the cleaning heads are activated, they pop up or extend beyond the surface of the pool to direct a jet of water from a nozzle across the adjacent surface to dislodge debris from the pool surface and place it in suspension for subsequent removal by the pool filter. Generally, these pop-up cleaning heads undergo incremental rotation, about their central axis, for each cycle of operation; so that different adjacent areas of the pool surface are cleaned by the jet of water emanating from the water nozzle in each cycle of operation of the head.

Formerly, swimming pool surfaces were finished with white or beige colored plaster; and the pop-up pool cleaning heads, and their surrounding sleeves, were manufactured of either a white colored plastic or a beige colored plastic, which blended in fairly well with the surface of the pool. Recently, however, it has become highly popular to finish the interior surface of the pool with a material resembling sand or pebbles; and these finishes are produced in a wide variety of colors and textures. Typical of such finishes are those sold under the name PebbleTec®, distributed by Pebble Tech, Inc. of Phoenix, Ariz. Other simulated sand surfaces also have been developed. With all of these surfaces, color and texture variations, from beige colored sand to exotic coral colors, extending into dark or nearly black colors, are produced. When standard water delivery systems including pop-up cleaning heads, made by a variety of manufacturers, are used with such sand-like or pebble finish pools, the standard white or beige colored heads frequently stand out as unattractive intrusions into the appearance of the pool surface, whether the heads are in use, or not in use in their retracted position.

In order to overcome the disadvantage of contrasting color appearance of cleaning heads and pool surfaces, pool cleaning system manufacturers can manufacture the cleaning heads and their associated adjacent sleeves and fittings out of a variety of different colored plastics. This, however, results in an extraordinary multiplication of the inventory which any pool dealer would need to carry, in order to anticipate all of the possible choices of pool finishes desired by its customers. The cost, to both the swimming pool cleaning system manufacturers and to distributors and retailers handling the products, would be prohibitive.

Efforts have been made, in conjunction with lawn sprinklers, to provide a top or a cover for a retractable sprinkler which is designed to simulate the appearance of the surrounding grass in order to make the lawn sprinkler less obtrusive. The U.S. Pat. No. to Sheets No. 4,429,832 discloses a sprinkler with a relatively large circular cap attached to the top of the sprinkler mechanism. This cap or lid is covered with a synthetic grass-like material; so that when the sprinkler retracts, the cap covering the sprinkler housing sleeve or pipe tends to hide the sprinkler location.

The U.S. Pat. No. to Sheets No. 3,709,435 is another sprinkler with a large circular lid on the top, covered with simulated grass, to hide the sprinkler when it is retracted. The lid on which the artificial grass is located is designed with beveled edges to rest against the edge or upper flange of the sprinkler housing to bear the weight of persons or vehicles passing over the top of the sprinkler.

The U.S. Pat. No. to Keyes No. 1,605,242 also is directed to a pop-up lawn sprinkler having a relatively large diameter cap extending up over the sprinkler mechanism itself. This cap is made of sufficient depth to carry a piece of sod and soil in it to keep the sod alive. When the sprinkler is retracted, the cap drops down into the top of the housing to conceal the sprinkler.

In all three of the lawn sprinkler patents mentioned above, it should be noted that the cap is a relatively large, permanent part of the overall structure of the sprinkler mechanism. The cap serves as a support surface for protecting the sprinkler mechanism when it is in its retracted position.

It is desirable to provide a decorative cover for attachment to the upper surface of the pop-up cleaning head of a water delivery system for a swimming pool to conceal the cleaning head when it is in its retracted position, and which overcomes the disadvantages of the prior art mentioned above.

SUMMARY OF THE INVENTION

It is an object of this invention to provide an improved decorative cover for attachment to the upper surface of a swimming pool cleaning head.

It is another object of this invention to provide an improved removable decorative cover attached to the upper surface of a pop-up swimming pool cleaning head.

It is an additional object of this invention to provide an improved decorative cover attached to the upper surface of a cleaning head for a swimming pool, in which the cover bears indicia and coloring selected to match the appearance of the pool floor surrounding the cleaning head.

It is a further object of this invention to provide an improved removable decorative cover bearing indicia and coloring selected to match the appearance of the pool floor surrounding a pop-up cleaning head, which may attached to the upper surface of the cleaning head.

In accordance with a preferred embodiment of the invention, a decorative cover is designed to be removably attached to the upper surface of a pop-up cleaning head in a swimming pool cleaning system, where the decorative cover bears indicia and color selected to match the appearance of the pool floor surrounding the pop-up cleaning head.

DETAILED DESCRIPTION

Figure 1:
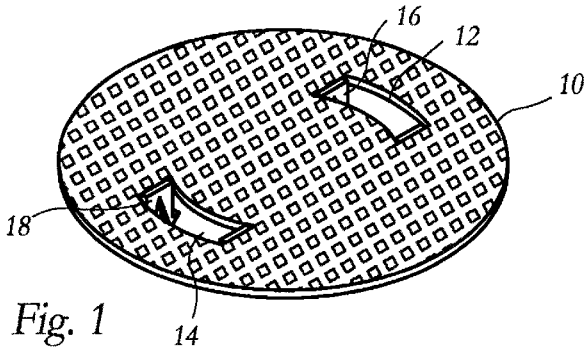
FIG. 1 is a top perspective view of a preferred embodiment of the invention.
Figure 2:
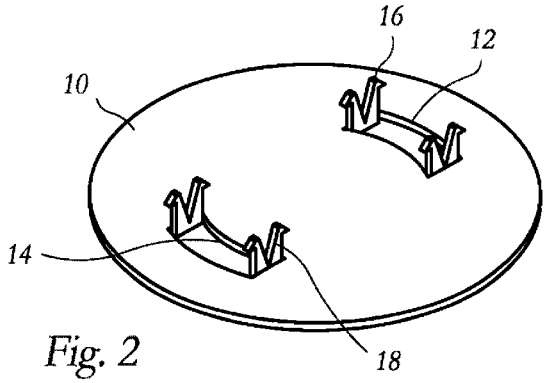
FIG. 2 is a bottom perspective view of the preferred embodiment of the invention.
Figure 3:
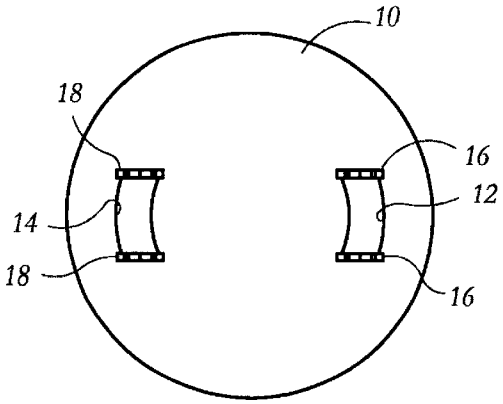
FIG. 3 is a bottom plan view of the embodiment shown in FIG. 2.
Figure 4:
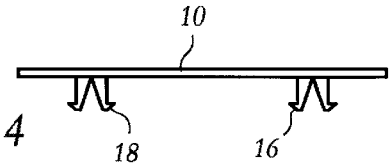
FIG. 4 is a side view of the embodiment shown in FIGS. 1 and 2.

Reference now should be made to the drawings, in which the same reference numbers are used throughout the different figures to designate the same or similar components. FIGS. 1 and 2 are top and bottom perspective views of a preferred embodiment of the invention. The preferred embodiment comprises a snap-fit releasable cap or cover for placement on the top of the pop-up head of an in floor swimming pool cleaning system. The cover 10 is of a circular configuration, with a pair of arcuate slots 12 and 14 extending through it on opposite sides, as shown clearly in FIGS. 1, 2 and 3.

The top of the cover carries a design with a pattern or indicia on it, and of a color made to match the surrounding surface of the swimming pool with which the cover 10 is used on the cleaning heads. Typically, such covers as the cover 10 shown in FIGS. 1 through 4 are used to conceal the pop-up head of an in floor swimming pool cleaning system, and to cause the head and its surrounding sleeve or collar to blend into the pebble-type finish or sand-like finish which is provided in many modern swimming pools.

Figure 12:
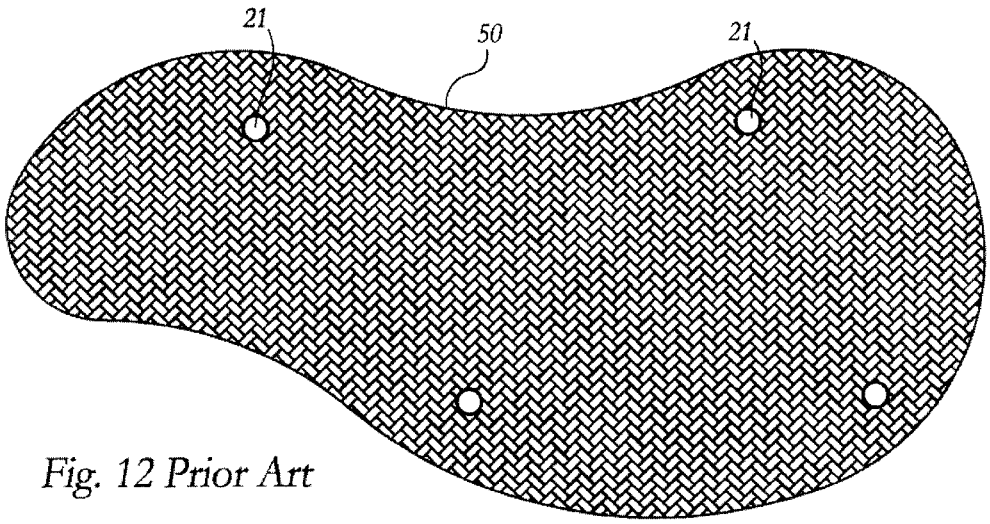
Fig. 12 Prior Art
FIG. 12 illustrates a prior art pool.

The cover 10 may be manufactured in a wide variety of patterns and colors to match a corresponding wide variety of pool finishes; so that when the cleaning heads are not in operation and are in their retracted or withdrawn position, the cover 10, with the indicia on it as shown in FIG. 1, conceals the cleaning head and its surrounding support sleeve, and blends in with the floor of the pool to camouflage the cleaning heads. This is shown in FIG. 12.

FIGS. 5, 6, 7 and 8 are perspective views of a diagrammatic nature illustrating the environment in which the cover 10 is used. Because details of the support sleeve and the actual pop-up mechanism of the cleaning head are not essential to an understanding of the present invention, these details are not shown in FIGS. 5, 6, 7 and 8, and specifically are not shown in the cross-sectional views of FIGS. 9 and 10. These various figures are simply used to illustrate the operating environment in which the cover 10 functions in conjunction with cleaning heads which may be made by different manufacturers for in floor cleaning systems using pop-up cleaning heads mounted in an external sleeve.

In FIGS. 5 through 10, an external sleeve 30 is illustrated as supporting the movable pop-up cleaning head mechanism. The sleeve 30 is secured onto the end of a water supply pipe (not shown), and is embedded in the concrete floor or wall of a swimming pool construction in a conventional manner. As shown most clearly in FIGS. 6, 8 and 10, the support sleeve 30 has an upper edge terminating in a flange 32. In a typical swimming pool, the floor finish, whether it is a plaster-finish or a pebble or sand-like finish of the type described above, is located in the same plane as the top of the flange 32.

The pop-cleaning head illustrated in FIGS. 5 through 10 includes a main body portion 20 having an opening 25 in the bottom of it for admitting water under pressure to move the head upwardly when water is supplied. The internal configuration for guiding the water through an exit or discharge nozzle 26 (shown in FIGS. 6 and 8), and for indexing the head each time it is reciprocally operated, as well as return springs and other mechanisms, are not shown in the drawings, since these mechanisms are well known. Again, the specific structure of the cleaning head is not important to an understanding of the nature of the present invention.

Cleaning heads, such as the cleaning head 20, terminate in a top 21; and heads currently are available with slots, circular openings or other indentations in the tops, such as the slots 22 and 24 shown in FIGS. 5, 6, 9 and 10. The arcuate slots 22 and 24 extend partially into the top of the cleaning heads, and in a conventional head construction, do not communicate with the water channel within the head for supplying water to the discharge nozzle 26. As mentioned previously, the cross-sectional views of FIGS. 9 and 10 do not show this internal water channel, but do show the slots through the top 21 of the head and the manner in which the cover 10 is attached in these slots.

In typical underwater mountings for pop-up cleaning heads, such as the heads 20/21, the slots 22 and 24 allow the insertion of a mating tool to be utilized for rotating the pop-up portion of the cleaning head to remove it from the sleeve 30 for repair and/or replacement. A variety of different configurations of slots or holes, such as the slots 22 and 24, are used by different manufacturers; but the overall concept is the same.

For utilization of a replacement or removable cover 10, such as shown in the various figures of the drawings, corresponding slots 12 and 14 are aligned with and are sized to overlie the slots 22 and 24, respectively. As shown most clearly in FIGS. 2, 4, 9 and 10, there are downwardly extending projections 16 adjacent the ends of the slot 12, and projections 18 adjacent the ends of the slot 14, with outwardly turned hooks at the distal ends of those projections. When the cover 10 is pressed downwardly in the direction indicated in FIGS. 5 and 6 to align the slots 12 and 14 with the corresponding slots 22 and 24, the projections 16 and 18 at the ends of the respective slots 12 and 14 extend through and into the slots 22 and 24 on the top 21 of the pop-up head mechanism. The outwardly turned ends on the projections 16 and. 18 then hook underneath the edges of the slots 22 and 24, as shown most clearly in FIGS. 9 and 10, to securely but removably hold the cover 10 in place on the top 21 of the head 20/21. When this is done, as shown in the cross-sectional view of FIG. 9 and in the perspective view of FIG. 7, the outer edge of the cover 10 extends over and completely covers the top surface of the flange 32 in the fixed sleeve 30 mounted in the pool floor or wall.

Figure 5:
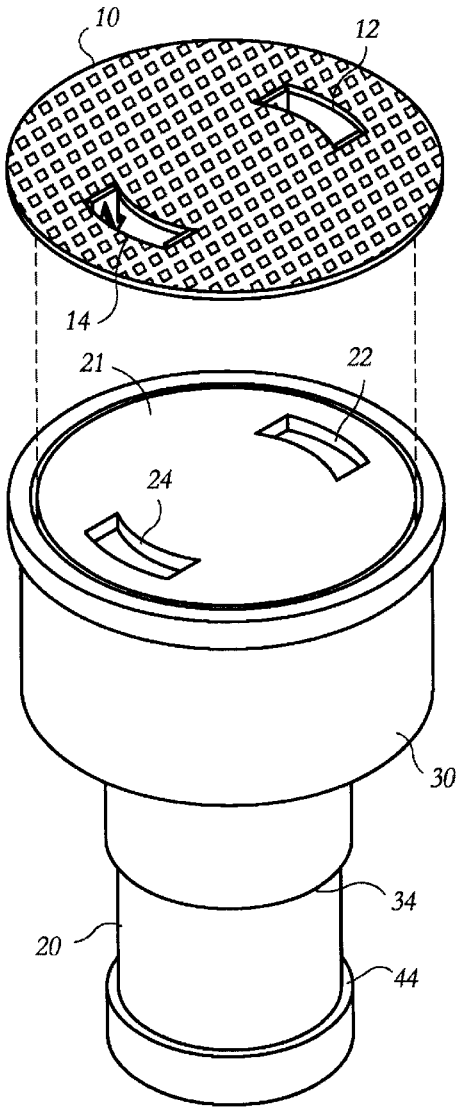
FIG. 5 is an exploded view illustrating the manner of utilization of the preferred embodiment of the invention shown in FIGS. 1 through 4.
Figure 6:
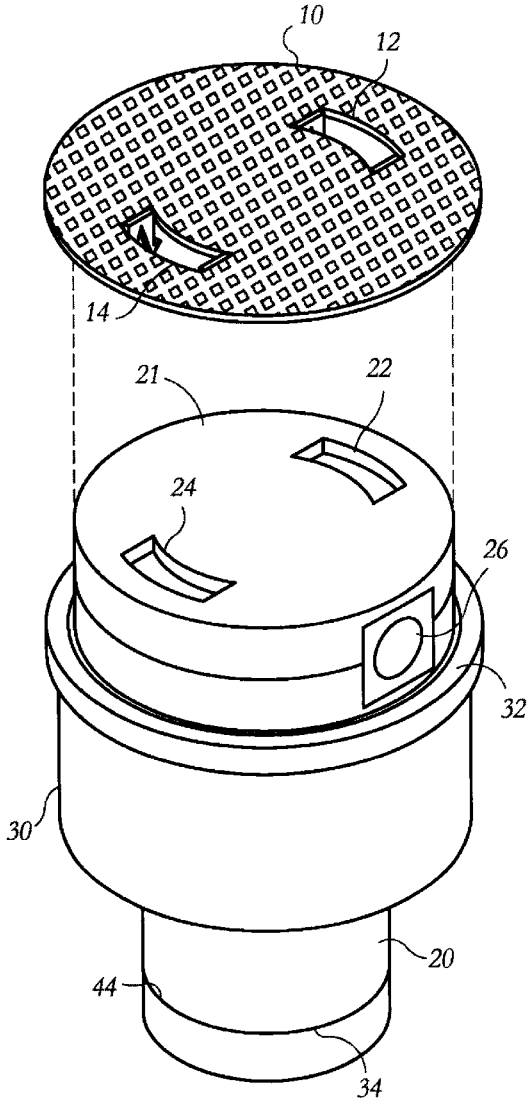
FIG. 6 is an exploded view illustrating a feature of a preferred embodiment of the invention.
Figure 7:
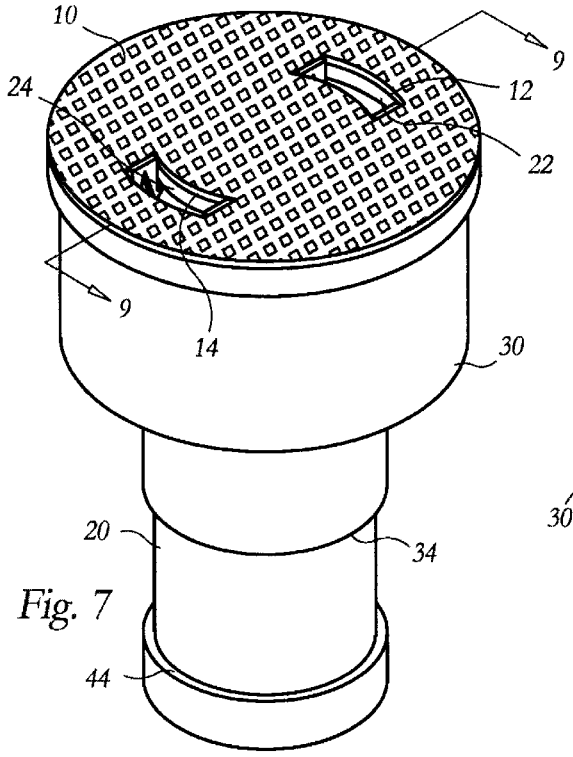
FIG. 7 is a top perspective view of the preferred embodiment of the invention in one position of operation.
Figure 9:
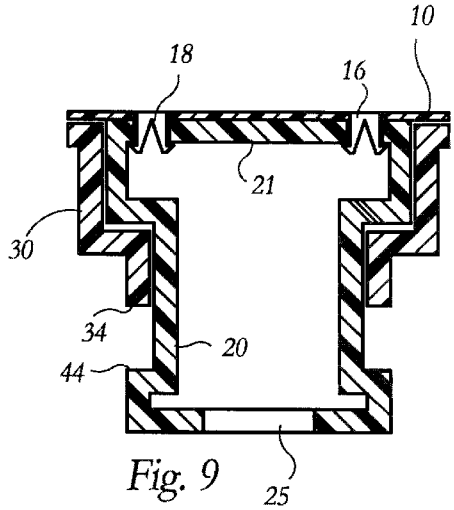
FIG. 9 is a cross-sectional view taken along the line 9—9 of FIG. 7.
Figure 8:
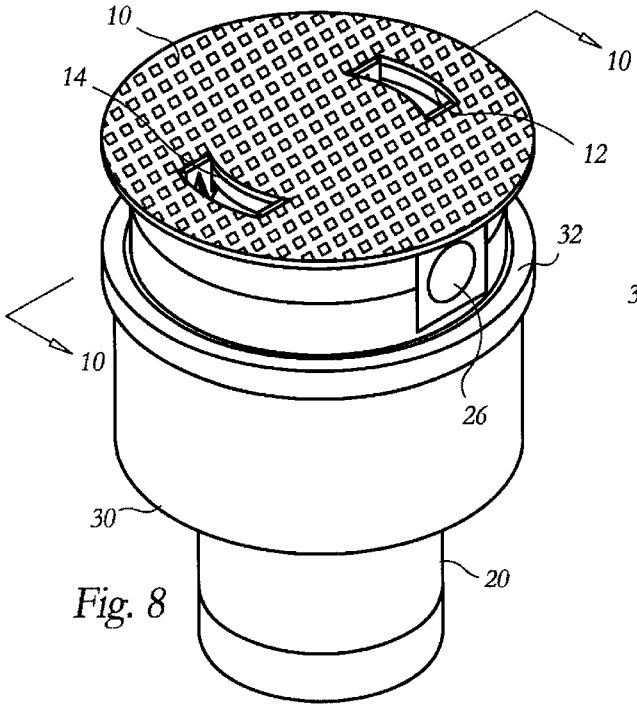
FIG. 8 is a top perspective view of the preferred embodiment of the invention in a second position of operation.
Figure 10:
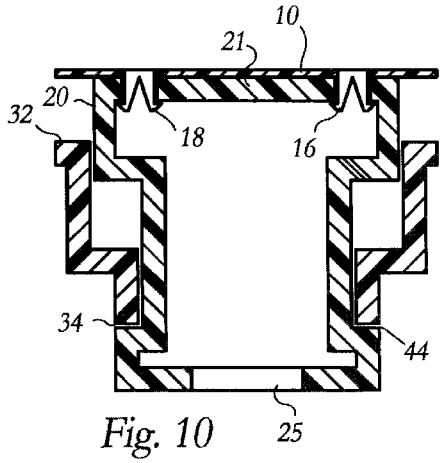
FIG. 10 is a cross-sectional view taken along the line 10—10 of FIG. 8.

When the pop-up head is in its raised position, as shown in FIGS. 6, 8 and 10, a shoulder 44 near the bottom of the pop-up head mechanism 20 and a shoulder 34 near the bottom of the sleeve 30 are engaged to limit the upward movement of the pop-up cleaning head, as shown most clearly in FIG. 10. The cover 10 is securely, but removably, attached to the top 21 of the pop-up portion of the cleaning head mechanism. When the device is in its retracted or inoperative position, as illustrated in FIGS. 5, 7, and 9, all of the cleaning head and its surrounding support sleeve 30 are covered by the decorative cover 10 to conceal the pop-up cleaning head mechanism and blend it in with the surrounding color and texture of the pool floor. Furthermore, the external diameter of the cover 10 can be somewhat greater than the external diameter of the support sleeve flange 32 to completely conceal the sleeve 30 and flange 32 to blend the cover 10 with the surrounding pool wall or floor surface.

A variety of different materials may be used to manufacture the head 10. Typically these include high impact plastics; and the entire assembly shown in FIGS. 1 through 4 may be fabricated by injection molding. Other materials, however, may be utilized as well, if desired, provided that the material out of which the cover 10 is made has suitable rigidity, and that the material is compatible with the chemicals typically found in swimming pool environments.

It also should be noted that the particular configuration showing the arcuate slots 12 and 14, and the particular configuration of the projections 16 and 18 to secure the cover 10 in place on the movable pop-up head 21, are to be considered as illustrative, since a number of different techniques may be used to attach the cover 10 to the pop-up head 20/21. The configuration shown is one which is compatible with a commercial head structure, is manufactured by Caretaker Systems, Inc. Other pop-up heads which are made by different manufacturers include different configurations in the top for facilitating replacement and removal of the heads; so that corresponding modifications to the mechanism for attaching the cover 10 to such heads would need to be made in order to cause the cover 10 to be compatible with such other structures.

Figure 11:
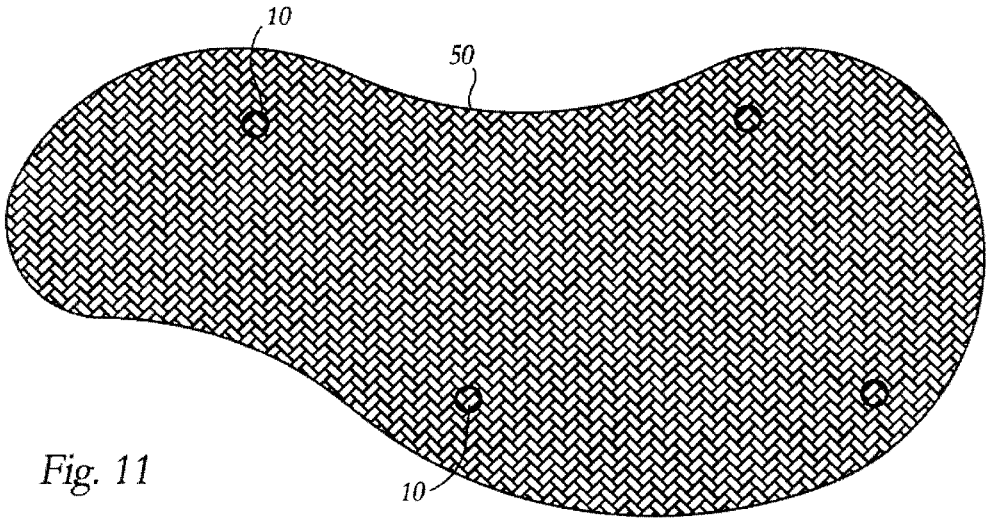
FIG. 11 illustrates a pool employing the preferred embodiment of the invention.

Reference now should be made to the diagrammatic representation of a prior art pool bottom 50 in FIG. 12 with the standard contrasting pop-up heads 21 clearly visible. This is particularly true when a sand or pebble finish is used for the pool. In contrast, when the matching covers 10 are used, the appearance is as shown in FIG. 11.

The foregoing description of the preferred embodiment of the invention is to be considered illustrative and not as limiting. Various changes and modifications will occur to those skilled in the art for performing substantially the same function, in substantially the same way, to achieve substantially the same results, without departing from the true scope of the invention as defined in the appended claims.

What is claimed is:

1. In an intermittently operated water delivery system used for cleaning pools having a pop-up water delivery cleaning head reciprocally mounted in a sleeve secured in the pool floor, with the upper end of the sleeve thereof generally flush with the surface of the pool floor, and with the upper surface of the cleaning head in its retracted inactive position being substantially co-planar with the upper surface of the sleeve, and the operative active position of the pop-up cleaning head being extended beyond the upper surface of the sleeve, an improvement including in combination:

a decorative cover attached to the upper surface of the cleaning head and bearing indicia and coloring selected to coordinate with the appearance of the pool floor surrounding the water delivery system wherein the dimensions of the decorative cover are selected to overlie the upper end of the sleeve with the pop-up cleaning head in its retracted inactive position.

2. The water delivery system according to claim 1 wherein the sleeve is a cylindrical sleeve, the upper surface of the cleaning head is of a circular configuration, and the decorative cover is a circular shape having a diameter greater than the diameter of the upper surface of the cleaning head.

3. The water delivery system according to claim 2 wherein the external diameter of the upper end of the sleeve and the diameter of the decorative cover are substantially the same, with the center of the decorative cover being located on the central axis of the sleeve.

4. The water delivery system according to claim 3 wherein the decorative cover is removably attached to the upper surface of the cleaning head.

5. The water delivery system according to claim 1 wherein the sleeve is a cylindrical sleeve with an outwardly extending flange on the upper end thereof, and wherein the decorative cover has a diameter selected to extend it over the flange on the sleeve with the cleaning head in the retracted inactive position thereof.

6. The water delivery system according to claim 5 wherein the decorative cover is removably attached to the upper surface of the cleaning head.

7. The water delivery system according to claim 1 wherein the sleeve is a cylindrical sleeve, the upper surface of the cleaning head is of a circular configuration, and the decorative cover is a circular shape having a diameter greater than the diameter of the upper surface of the cleaning head.

8. The water delivery system according to claim 7 wherein the external diameter of the upper end of the sleeve and the diameter of the decorative cover are substantially the same, with the center of the decorative cover being located on the central axis of the sleeve.

9. The water delivery system according to claim 1 wherein the decorative cover is removably attached to the upper surface of the cleaning head.

10. In an intermittently operated water delivery system used for cleaning pools a pop-up water delivery cleaning head is reciprocally mounted in a cylindrical sleeve secured in the pool, the sleeve having the upper end thereof generally flush with the surface of the pool floor, and wherein the upper surface of the cleaning head in its retracted inactive position is substantially co-planar with the upper end of the sleeve, and further wherein the upper surface of the cleaning head has a slot therein, an improvement including in combination:

a decorative cover in the form of a circular member having an upper surface and a lower surface, with a slot therethrough aligned with the slot in the upper surface of the cleaning head;

depending resilient projections extending from the edge of the slot on the lower surface of the decorative cover for engaging the slot in the upper surface of the cleaning head for removably securing the decorative cover to the upper surface of the cleaning head; and the upper surface of the decorative cover bearing indicia and coloring selected to match the appearance of the pool floor surrounding the water delivery system.

11. The water delivery system according to claim 10 wherein the slot in the upper surface of the cleaning head a pair of spaced slots and the projections for removably securing the decorative cover includes projections for engaging each of the spaced slots.

12. The water delivery system according to claim 11 wherein the decorative cover has a pair of spaced slots aligned with the spaced slots in the upper surface of the cleaning head with resilient projections depending therefrom for engagement in each of the respective spaced slots of the upper surface of the cleaning head to hold the decorative cover in place on the top of the cleaning head.

13. The water delivery system according to claim 12 wherein the dimensions of the decorative cover are selected to overlie the upper end of the sleeve with the pop-up cleaning head in its retracted inactive position.

14. The water delivery system according to claim 13 wherein the sleeve is a cylindrical sleeve, the upper surface of the cleaning head is of a circular configuration, and the decorative cover is a circular shape having a diameter greater than the diameter of the cleaning head.

15. The water deliver system according to claim 14 wherein the external diameter of the upper end of the sleeve and the diameter of the decorative cover are substantially the same, with the center of the decorative cover being located on the central axis of the sleeve.

16. The water delivery system according to claim 10 wherein the sleeve is a cylindrical sleeve with an outwardly extending flange on the upper end thereof, and wherein the decorative cover has a diameter selected to extend it over the flange on the sleeve with the cleaning head in the retracted inoperative position thereof.

17. The water delivery system according to claim 12 wherein the sleeve is a cylindrical sleeve with an outwardly extending flange on the upper end thereof, and wherein the decorative cover has a diameter selected to extend it over the flange on the sleeve with the cleaning head in the retracted inoperative position thereof.

* * * * *